United States Patent [19]

Meyers et al.

[11] 4,426,281

[45] Jan. 17, 1984

[54] FLOAT/SINK TREATMENT OF CRUSHED COAL IN SOLUTIONS OF MONOSACCHARIDES AND DISACCHARIDES

[75] Inventors: Robert A. Meyers, Tarzana; Walter D. Hart, Upland, both of Calif.

[73] Assignee: TRW Inc., Redondo Beach, Calif.

[21] Appl. No.: 303,740

[22] Filed: Sep. 21, 1981

Related U.S. Application Data

[63] Continuation-in-part of Ser. No. 144,154, Apr. 28, 1980.

[51] Int. Cl.[3] ..... B03B 5/44

[52] U.S. Cl. ..... 209/11; 209/173; 209/164; 209/211; 209/422; 208/8 LE; 252/60; 494/85

[58] Field of Search ..... 208/8 LE; 252/60, 61; 209/173, 172.5, 172, 11, 459, 211, 13, 18, 422, 441, 164–167; 44/1 SR; 233/27

[56] References Cited

U.S. PATENT DOCUMENTS

| | | | |
|---|---|---|---|
| 1,158,959 | 11/1915 | Beach | 233/27 |
| 1,754,923 | 4/1930 | Wiegand | 209/173 |
| 2,105,294 | 1/1938 | Weinig | 209/11 X |
| 2,376,703 | 5/1945 | Kuhlwein | 209/173 X |
| 2,590,756 | 3/1952 | Colin et al. | 209/173 |
| 2,615,572 | 10/1952 | Hodge | 209/459 X |
| 3,016,138 | 1/1962 | Le Baron et al. | 209/459 |
| 3,794,159 | 2/1974 | Singewald | 209/166 X |
| 3,869,559 | 3/1975 | Clark | 209/211 X |
| 3,926,793 | 12/1975 | Wise | 209/504 X |
| 4,169,787 | 10/1979 | Gunnerson | 209/173 |
| 4,217,201 | 8/1980 | Chervenak | 208/10 X |

FOREIGN PATENT DOCUMENTS

| | | | |
|---|---|---|---|
| 1001274 | 2/1952 | France | 209/173 |
| 1724 | of 1858 | United Kingdom | 209/173 |
| 14928 | of 1913 | United Kingdom | 209/173 |

OTHER PUBLICATIONS

Taggart, Handbook of Mineral Dressing, John Wiley & Sons, NY, NY (1945), pp. 11–117, 1945.

Perry, Chemical Engineers Handbook, 4th Ed., McGraw–Hill Book Co., NY, NY 1963, pp. 3–89, 3–90, 3–201.

*Primary Examiner*—Ralph J. Hill

*Attorney, Agent, or Firm*—Robert W. Keller; Patrick F. Bright; Donald R. Nyhagen

[57] ABSTRACT

A method for removing ash, sulfur and inertinite from crushed coal includes float/sink treatment in aqueous solutions of monosaccharides, disaccharides, hydrogenated monosaccharides, hydrogenated disaccharides and mixtures thereof. Such solutions also improve the performance of such heavy media physical cleaning equipment as cyclones, heavy media baths, tables, spirals, hydroclones, flotation cells, jigs and solid-bowl centrifuges.

13 Claims, No Drawings

FLOAT/SINK TREATMENT OF CRUSHED COAL IN SOLUTIONS OF MONOSACCHARIDES AND DISACCHARIDES

This application is a continuation-in-part of U.S. Patent Application Ser. No. 144,154, filed Apr. 28, 1980, and entitled, "Saccharide Heavy Media for Coal Cleaning."

This invention relates to new methods for physically cleaning crushed coal containing significant amounts of ash and sulfur in aqueous media containing one or more sugars to reduce the ash and sulfur content of the coal, thus producing coal having higher BTU content and lower sulfur and ash content per unit weight. More particularly, the invention relates to methods for treating crushed coal with aqueous float/sink media which are low in cost, miscible with water over a broad range of concentrations, stable, non-toxic, non-corrosive and low in viscosity. Because the new float/sink media satisfy all these criteria, they are ideal for cleaning crushed coat. See to this effect the seminal work titled, "Coal Preparation", by E. R. Palowitch and A. W. Deurbrouck, American Institute of Mining Metallurgical and Petroleum Engineers, Inc., J. W. Leonard and D. R. Mitchell, Eds., N.Y., 1968.

Prior art float/sink media for treating crushed coal include dispersions and solutions containing a wide variety of dispersants and solutes. However, many are toxic, unstable, high in cost, corrosive, unacceptably viscous, immiscible with water or miscible only over limited ranges of concentration. This invention provides aqueous float/sink media that have none of these shortcomings.

According to this invention, crushed coat containing substantial amounts of ash and sulfur is subjected to aqueous float/sink solutions including at least one substance selected from the group consisting of monosaccharides, disaccharides, hydrogenated monosaccharides, hydrogenated disaccharides, and mixtures thereof. Crushed coal includes coals having maximum dimensions as large as about 1.5 inches, and as small as 325 mesh and smaller. Such coals may contain about 30% to about 60% ash by weight and about 2% to about 5% sulfur by weight. After treatment with our new float/sink solutions, these coals have ash content of less than 10%, and even less than 5% by weight. Sulfur content drops 25% to 35% or even more.

Among the monosaccharides, hydrogenated monosaccharides, disaccharides, and hydrogenated disaccharides that are useful in the new aqueous float/sink solution are such dissacharides as sucrose and lactose, such monosaccharides as glucose, dextrose, fructose and mannose, such hydrogenated disaccharides as sorbitol, such hydrogenated monosaccharides as mannitol and such mixtures as corn syrup, turbinados, blackstrap and meladura.

The quantity of monosaccharides, disaccharides, and hydrogenated mono- and disaccharides in water is sufficient to attain a solution with specific gravity in the range of about 1.25 to about 1.5, preferably in the range of about 1.3 to about 1.4. In this preferred range, the float coal obtained from our process contains surprisingly small amounts of inertinite, which facilitates substantially complete liquifaction of the float coal and substantially obviates the need to filter the dissolved float coal. Pumping problems are also minimized because liquifaction of the float coal produces a substantially completely liquified product. For example, when we treated Western Kentucky coal containing about 12% inertinite having average particle size of 200 mesh by zero with a 1.33 specific gravity solution of corn syrup and water at 20° C., we obtained a float coal containing lss than about 2% inertinite. Thus, more than 80% of the inertinite in the feed coal was excluded from the float coat, and passed into the sink coal. The ash content of the float coal was also reduced by more than 80% from the feed coal, and the sulfur content of the feed coal was reduced by one-third. As a result, the float coal contained about 100 more BTU's per pound than the feed coal.

The aqueous float/sink solution can be heated to a temperature in the range of about 20° C., to about 100° C., more preferably to a temperature in the range of about 20° C., to about 60° C., to substantially reduce the viscosity of the solution without significantly reducing its specific gravity. Alternatively, by using our new solutions in heavy media cleaning equipment to beneficiate crushed coal, we can dispense with heating because the high "g" forces generated in such apparatus effectively reduce the viscosities of our solutions. The weight ratio of aqueous float/sink solution to coal used in such devices is generally in the range of 1:1 to about 10:1. When separation is completed, the float coal is recovered, and is ready for use. No further cleaning of the float coal is necessary because the residual solution on the coal simply forms carbon dioxide when burned.

Aqueous solutions of monosaccharides, disaccharides, hydrogenated monosaccharides, hydrogenated disaccharides, and mixtures thereof, are also useful for physically cleaning crushed coals in such heavy media cleaning equipment as heavy media baths, cyclones, tables, spirals, jigs, hydroclones, flotation cells, and solid-bowl centrifuges. When used in some of these devices, our aqueous solutions can have specific gravities as low as about 1.1 and still effect a substantial difference in coal particle settling rate such that efficient separation of ash-lean from ash-rich coal particles can be effected.

For example, if a jig is used to separate coal particles of 1.3 specific gravity from those of 1.5 or above, a sugar solution made up to 1.2 specific gravity will, according to Stokes' Law, result in nearly a twofold difference (actually, 1.7) in the settling rate between such particles computed as follows: settling rate ($R_{1.3}/R_{1.5}$) equals $\sqrt{1.3-1.2}/\sqrt{1.5-1.2}$ or 1.7. By contrast, use of water alone, as is normal in jigs, results in a differential settling rate of only 1.3, computed as follows: $R_{1.3}/R_{1.5}$ equals $\sqrt{1.3-1.0}/\sqrt{1.5-1.0}$ or 1.3. In another example the differential settling rate of particles of 1.30 and 1.35 specific gravity in a sugar solution of 1.2 specific gravity is 1.7; in water only, the differential rate is 1.1. Thus, the jig will be better able to separate particles of very slightly different specific gravities using our new solutions. Our aqueous media can be used alone or in combination with aqueous dispersions of such substances as magnetite.

In heavy media baths and cyclones, our aqueous media stabilize dispersions of such substances as magnetite, thus improving their capacity to beneficiate crushed coal. In jigs, tables, spirals, hydroclones, and flotation cells, our solutions increase the density of the water media used in such devices, and improve their performance. In solid-bowl centrifuges, our aqueous media permit operation at high "g" forces, resulting in high rates of throughput and separation. The weight ratio of our aqueous media to coal in such devices is preferably in the range of about 1:1 to about 10:1.

In one series of actual runs, we obtained a water slurry of Camp No. 11 Kentucky coal that had been discarded as waste from a state-of-the-art coal cleaning plant. After drying, this coal had particle size of 14 by 200 mesh, ash content of about 39.6% by weight, heat content of 8,389 BTU's per pound, and a sulfur content of 3.94% by weight. We treated this so-called waste coal at 20° C., and atmospheric pressure with an aqueous float/sink corn syrup solution having a specific gravity of 1.39. We carried out one treatment for about 10 minutes in a centrifuge operating at about 4,500 rpm, and recovered about 41.8% by weight of the feed as float coal. We found that this float coal had a low ash content of about 5.76% by weight, a greatly increased heat value of 13,366 BTU's per pound, and a reduced sulfur content of about 2.64% by weight.

In a second run at 20° C., in the same device and at the same speed, with the same starting material, and the same float/sink solution, we recovered 47.5% by weight of the feed as float coal, and found this float coal had an ash content of 3.9%.

In a third run in the same device at the same speed and temperature, with the same starting material and the same float/sink solution of 1.39 specific gravity but containing both corn syrup and 0.5% by weight Nopco 8050, a modified sulfonated non-fatty ester defoaming agent, we recovered 49.7% by weight of the feed, and found that this float coal contained just 4% ash by weight.

In a fourth run at 95° C., in the same device at 4,500 rpm, and using an aqueous solution having a 1.39 specific gravity and containing corn syrup and 0.5% by weight Nopco 8050, we obtained 48.4% recovery of the feed, and found that this float coal contained just 4% by weight ash.

In a fifth run at 95° C., in the same device at 4,500 rpm, using the same float/sink media solution used in the first run, we recovered 42.9% of the feed coal as float. This float coal contained just 4% ash by weight.

These data prove that our new media provide a practicable method for beneficiating so-called waste coal over a broad temperature range. They show recovery of substantial yields of low-ash, low-sulfur coal that is comparable in quality to commercially available coals.

What is claimed is:

1. A method comprising subjecting crushed coal having sizes no larger than about 14 mesh and comprising up to about 60% ash by weight, up to about 5% sulfur by weight, or both, to the gravitational forces of a cyclone using an aqueous media having a specific gravity in the range of about 1.3 to about 1.4 which incluces at least one substance selected from the group consisting of monosaccharides, disaccharides, hydrogenated monosaccharides, hydrogenated disaccharides and mixtures thereof, and recovering from said cyclone a float coal having substantially lower ash content, sulfur content, or both.

2. The method of claim 1 wherein the monosaccharides, disaccharides, hydrogenated monosaccharides, hydrogenated disaccharides and mixtures thereof are selected from the group consisting of sucrose, lactose, sorbitol, glucose, dextrose, fructose, mannose, mannitol, corn syrup, turbinados, blackstrap and meladura.

3. The methods of claims 1 and 2 wherein said aqueous solution is heated to a temperature in the range of about 40° C. to about 100° C., to reduce its viscosity substantially without substantially reducing its specific gravity.

4. A method comprising subjecting crushed coal having sizes no larger than about 14 mesh and comprising up to about 60% ash by weight, up to about 5% sulfur by weight, or both, to the gravitational forces of a solid-bowl centrifuge using an aqueous media having a specific gravity in the range of about 1.3 to about 1.4 which includes at least one substance selected from the group consisting of monosaccharides, disaccharides, hydrogenated monosaccharides, hydrogenated disaccharides and mixtures thereof, and recovering from said solid-bowl centrifuge a float coal having substantially lower ash content, sulfur content, or both.

5. The method of claim 4 wherein the monosaccharides, disaccharides, hydrogenated monosaccharides, hydrogenated disaccharides and mixtures thereof are selected from the group consisting of sucrose, lactose, sorbitol, glucose, dextrose, fructose, mannose, corn syrup, turbinados, blackstrap and meladura.

6. The methods of claims 4 or 5 wherein said aqueous solution is heated to a temperature in the range of about 40° C. to about 100° C., to reduce its viscosity substantially without substantially reducing its specific gravity.

7. A method comprising immersing crushed coal having sizes no larger than about 14 mesh and comprising more than about 2% inertinite by weight, up to about 60% by weight ash, and up to about 5% by weight sulfur, in an aqueous float/sink solution having a specific gravity in the range of about 1.3 to about 1.4 and including at least one substance selected from the group consisting of monosaccharides, disaccharides, hydrogenated monosaccharides hydrogenated disaccharides and mixtures thereof; subjecting the resulting crushed coal/solution blend to the gravitational forces of a centrifuge or a cyclone to produce a float/crushed coal having less than about 2% inertinite by weight, substantially reduced ash content, substantially reduced sulfur content, or both, and recovering said float coal from said solution.

8. The method of claim 7 wherein the monosaccharides, disaccharides, hydrogenated monosaccharides, hydrogenated disaccharides and mixtures thereof are selected from the group consisting of sucrose, lactose, sorbitol, glucose, dextrose, fructose, mannose, mannitol, corn syrup, turbinados, blackstrap and meladura.

9. The method of claim 8 or 7 wherein the float/sink solution is heated to a temperature in the range of about 40° C. to about 100° C., to reduce its viscosity substantially without substantially reducing its specific gravity.

10. The method of claim 7 wherein said blend is subjected to the physical forces of a device selected from the group consisting of: A jig, a table, flotation cell, a solid-bowl centrifuge, a cyclone, a hydroclone and a spiral.

11. A method for cleaning crushed coal comprising immersing crushed coal having sizes not larger than about 14 mesh and having up to about 60% by weight ash, up to about 5% by weight sulfur, or both, in an aqueous float/sink solution having a specific gravity in the range of about 1.3 to about 1.4 and including at least one substance selected from the group consisting of monosaccharides, disaccharides, hydrogenated monosaccharides, hydrogenated disaccharides and mixtures thereof; heating said crushed coal/solution to a temperature in the range of about 40° to about 100° C. to reduce its viscosity without substantially reducing its specific gravity; subjecting the heated crushed coal/solution to the gravitational forces of a centrifuge or a cyclone to produce a float coal having a substantially reduced ash or sulfur content, or both, and then recovering said float coal from said solution.

12. The method of claim 11 wherein the monosaccharides disaccharides, hydrogenated monosaccharides, hydrogenated disaccharides and mixtures thereof are selected from the group consisting of sucrose, lactose, sorbitol, glucose, dextrose, fructose, mannose, mannitol, corn syrup, turbinados, blackstrap and meladura.

13. The method of claim 11 wherein said crushed coal includes more than about 2% inertinite by weight, and said float coal has less than about 2% by weight inertinite.

* * * * *